US005563903A

United States Patent [19]

Jebrail et al.

[11] Patent Number: 5,563,903

[45] Date of Patent: Oct. 8, 1996

[54] ALUMINUM MELTING WITH REDUCED DROSS FORMATION

[75] Inventors: Fatemeh F. Jebrail, Bryan, Tex.; Arthur W. Francis, Jr., Monroe; Hisashi Kobayashi, Putnam Valley, both of N.Y.

[73] Assignee: Praxair Technology, Inc., Danbury, Conn.

[21] Appl. No.: 489,917

[22] Filed: Jun. 13, 1995

[51] Int. Cl.[6] ..... H05B 7/00

[52] U.S. Cl. ..... 373/22; 373/8; 373/80; 75/672

[58] Field of Search ..... 373/22, 18, 24, 373/80, 72, 8; 75/687, 709, 672, 686; 266/901

[56] References Cited

U.S. PATENT DOCUMENTS

| | | | |
|---|---|---|---|
| 3,809,378 | 5/1974 | Iida | 266/33 R |
| 4,327,901 | 5/1982 | Kaiser | 266/217 |
| 4,657,586 | 4/1987 | Masterson et al. | 75/76 |
| 4,699,654 | 10/1987 | Maddever et al. | 75/10.45 |
| 4,796,277 | 1/1989 | Maddever et al. | 373/72 |
| 4,957,050 | 9/1990 | Ho | 110/346 |
| 5,076,779 | 12/1991 | Kobayashi | 431/5 |
| 5,176,086 | 1/1993 | Clark et al. | 110/346 |
| 5,421,856 | 6/1995 | Lazcano-Navarro | 75/672 |

*Primary Examiner*—Tu Hoang
*Attorney, Agent, or Firm*—Stanley Ktorides

[57] ABSTRACT

An aluminum melting method wherein an atmosphere above the aluminum charge is comprised of two strata, a lower strata covering the aluminum charge comprised of a non-oxidizing gas and an upper strata comprised of combustion gases from one or more burners. Heat from the burner or burners radiatively heats and melts the aluminum while the lower strata protects the aluminum from oxidative effects which would result if the aluminum surface were contacted with the combustion gases, thus serving to reduce dross formation.

10 Claims, 5 Drawing Sheets

ALUMINUM MELTING WITH REDUCED DROSS FORMATION

FIELD OF THE INVENTION

This invention relates generally to the field of aluminum melting and is particularly useful for recycling aluminum.

BACKGROUND OF THE INVENTION

Recycling of scrap aluminum has grown substantially in recent years due to legislation and to efforts by the aluminum industry to reduce energy consumption and capital investment. About one half of scrap aluminum comes from mill wastes. The amount of scrap from used beverage cans, however, has grown rapidly causing a demand for new melting and refining capacity.

In order to improve the economics of recycling, substantial improvements have been made in the design and operation of aluminum melting furnaces. Better control of the temperature set point and combustion stoichiometry have improved fuel efficiency. Dross formation, i.e. formation of oxide on the surface of the aluminum during heating, has been reduced somewhat by improved operating practices. In direct-fired furnaces, however, further dross reduction has been limited by the presence of oxidative gases in the furnace atmosphere, particularly oxygen and combustion products that are emitted from the direct-fired burner. Specifically, the atmosphere of a direct-fired furnace contains $CO_2$, $H_2O$ and $O_2$, to which the aluminum charge is constantly exposed. The combined concentration of $CO_2$, $H_2O$ and $O_2$ is typically about 30% when air is used as the oxidant. Most dross formed during aluminum melting is believed to result from contact with these oxidizing gases. Although the effects of melt temperature, melt composition, and furnace atmosphere on the rate of oxidation are reasonably well understood, improvements in the amount of dross formed have been limited.

Use of a controlled atmosphere in an indirectly-fired furnace which heats the aluminum charge from radiant tubes can reduce oxidation loss substantially. But the reduced heat transfer rates, corrosion of the radiant tubes and high capital and maintenance costs of such furnaces make them uneconomical.

There is therefore a need for a direct-fired aluminum melting practice that results in substantially less oxidation and dross formation without substantially increasing capital or production costs.

SUMMARY OF THE INVENTION

The invention relates to an improved process for melting a charge of aluminum in a direct-fired furnace. The charge is introduced into the furnace and exposed to radiant heat from one or more direct-fired burners placed above the charge. A non-oxidizing gas is introduced between the direct-fired burner(s) and the aluminum charge to create an atmospheric stratum near the charge that substantially shields the charge from the normal furnace atmosphere which includes combustion products resulting from the direct-firing. This non-oxidizing atmosphere stratum has a composition that decreases oxidation of the charge compared to the oxidation that would have taken place in the absence of this stratum.

DETAILED DESCRIPTION OF THE INVENTION

The present invention relates to stratification of the atmosphere within a direct-fired aluminum melting furnace in order to achieve beneficial results in the heating and melting of aluminum. By "stratification," we mean that an atmospheric stratum is created between the direct-fired burner or burners in the furnace and the aluminum, that serves to substantially shield the aluminum from the furnace combustion products. The stratum has a composition that decreases oxidation of the aluminum charge that would otherwise occur. This stratum is achieved by introduction of a non-oxidizing gas or mixture of non-oxidizing gases into the furnace. A stratum resulting above the non-oxidizing stratum that contains a higher amount of combustion products is termed a "combustion stratum".

The non-oxidizing layer or stratum and combustion gas layer or stratum will mix with each other to some extent; thus the two need not be, and usually will not be, entirely distinct. Nevertheless, as a result of introducing the non-oxidizing gas and creating the non-oxidizing stratum, oxidation of the aluminum charge material can be controlled in a manner substantially independent of the composition and oxidative properties of the combustion stratum. A furnace containing such a stratified atmosphere substantially retains the advantages of a direct-fired furnace (e.g., high heat transfer rate and low cost) but allows control of the atmosphere to which the charge is exposed.

Figure 1:
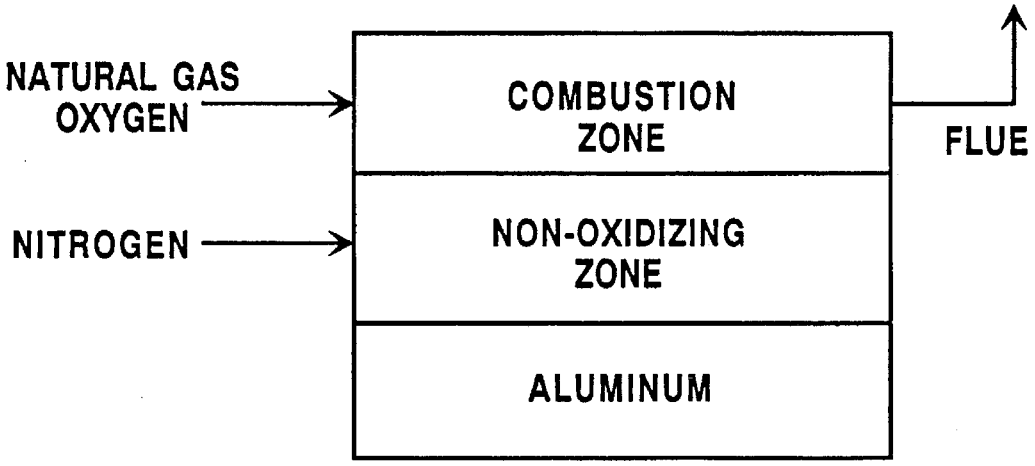
FIG. 1 is a simplified schematic representation of a stratified atmosphere aluminum melting furnace system in accordance with this invention.

FIG. 1 depicts a "stratified" furnace atmosphere that contains two strata: the combustion stratum and the non-oxidizing stratum. The combustion stratum contains a higher concentration of combustion products from the burner, i.e., the $CO_2+O_2+H_2O$ emitted from the burner which are oxidizing to aluminum, than the non-oxidizing stratum. The non-oxidizing stratum is substantially inert or reducing with respect to the aluminum charge and will shield the aluminum charge from those combustion products. Examples of an inert gas which may be used in the practice of this invention include nitrogen and argon. Nitrogen is particularly advantageous because of its low cost and low environmental impact. Argon, however, may better protect the charge from oxidation because it is heavier than air and thus less likely to mix with the burner combustion products. Examples of reducing gases which may be used in the practice of this invention include hydrogen, methane and other hydrocarbons. Such introduction of an inert or reducing gas reduces the amount of aluminum that is lost as dross, i.e., as a result of oxidation at the aluminum surface.

This translates into a substantial benefit in a typical aluminum recycling operation, where large amounts of aluminum are recycled, and the volume of aluminum metal lost as dross is substantial.

In general, it is advantageous to minimize mixing of the uncontrolled atmosphere of the combustion stratum with the controlled atmosphere of the non-oxidizing stratum. This means largely avoiding mixing of the combustion products from the directly-fired burner into the non-oxidizing gas. The oxidizing gases are reduced near the surface of the aluminum charge to less than 50 percent of the level that prevails without the inert gas. More preferably, the oxidizing gases are reduced to a level less than 10 percent of the level that exists without inert gas, and most preferably below 5 percent. This can be accomplished by selection of the composition of the non-oxidizing gas, by adjustment of its flow rate and velocity, by strategic positioning of the furnace exhaust or flue, and by strategic positioning and orientation of the non-oxidizing gas introduction point(s) with respect to the charge and the burner.

The throughput (flow rate) of the non-oxidizing gas can be adjusted to attain the desired reduction in oxidizing gases. A higher flow rate of non-oxidizing gas will generally result in a greater reduction. Nevertheless, because of resulting higher fuel requirements and the additional cost of non-oxidizing gas, a compromise is usually stuck between oxidative conditions tolerated proximal to the charge and non-oxidizing gas flow rate. The lowest flow rate that achieves the desired reduction in oxidizing gases is preferred.

Within limits, as will be appreciated by those skilled in the art, the flow rate and velocity of gases from the burner (as well as their velocity) can also be selected to reduce the level of oxidizing species near the charge. For example, a low-velocity type burner is preferred because its low velocity reduces mixing of combustion products with the non-oxidizing stratum. A premixed radiant-type burner, well known in the art, is one such low-velocity burner. But while radiant burners generally emit very low velocity combustion products, the surface temperature of the burner is limited by flashback which results when the flame front moves back into the porous radiant element and causes overheating of the element.

Figure 2:
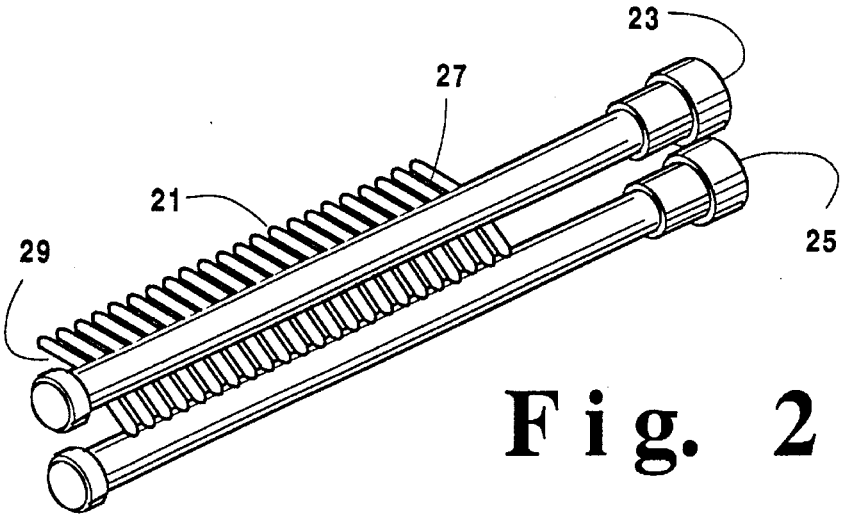
FIG. 2 depicts an example of an oxygen-fuel type burner for use in direct-fired furnaces.

A low velocity, laminar flame type oxygen-fuel burner is most preferred for use in the furnace according to the invention. A non-limiting example of such a burner is schematically shown in FIG. 2, and further described in the Example below. The burner 21 in FIG. 2 is typical of such burners. It has two inlet tubes, one each for fuel 23 (usually natural gas) and oxygen or oxygen-enriched air 25. The fuel and oxygen exit respectively through upper and lower rows of outlet tubes 27 and 24. A laminar flame can be produced using such a burner, minimizing mixing of combustion products with the inert gas.

Laminar flames are obtained at low velocities and transition to turbulent flames occurs at a fuel jet Reynolds number (Re) between 2,000 to 10,000, depending on the type of fuel. For methane the transition may occur at about Re=3,000. The bulk of the furnace flow field tends to become turbulent even when laminar flames are used and the bulk mixing of the combustion gases and the non-oxidizing layer is controlled by the turbulent mixing process. When turbulent flames are used, mixing between the flame and surrounding gases become more rapid, and a greater amount of non-oxidizing gas in the non-oxidizing layer is generally required to achieve the same degree of stratification.

The velocity of the non-oxidizing gas introduced into the furnace should not exceed 50 feet per second (fps) and preferably is less than 20 fps.

The position of the flue or exhaust port within the furnace is also important for minimizing mixing by making it possible to discharge gases from the combustion stratum (and from the non-oxidizing stratum) without causing substantial mixing of the two strata. It is most preferred to locate the flue in or near the furnace ceiling, for example directly above the burner. Determining the optimum flue position for a particular furnace may require some experimentation. It also may be desirable to employ more than one flue port, such as adding an additional flue port at or about the level of introduction of the non-oxidizing gas, to separately exhaust some of the non-oxidizing gas.

The non-oxidizing gas is introduced into the furnace at any vertical level below the burner. In general it is preferable to place the injection point of the non-oxidizing gas close to the aluminum charge surface so as to increase the vertical distance between the non-oxidizing gas and the burner to minimize mixing of the non-oxidizing and combustion layers. Preferably the non-oxidizing gas is introduced into the furnace through multiple injection ports distributed in the side walls of the furnace. The non-oxidizing gas should fill the space between the burner combustion gases and the aluminum charge. To accomplish this, various parameters of the particular furnace may need be adjusted, e.g., flue position, gas flows, position and orientation of non-oxidizing gas ports. The number and diameter of the non-oxidizing gas ports may need to be adjusted as well. It is desirable to have multiple non-oxidizing gas ports distributed along the side walls and to keep the gas velocity low. The total momentum flux of the non-oxidizing gas should be kept below the total momentum flux of the burner gases.

Generally during the aluminum melting the molten aluminum bath will tend to stratify by temperature, with the hotter molten aluminum in the upper layer of the molten aluminum bath. In such cases it is preferable that at least some of the non-oxidizing gas be passed into the furnace by being bubbled through the molten aluminum. This will stir the molten aluminum and serve to better distribute the heat from the combustion throughout the molten aluminum, resulting in a homogenized bath temperature for the molten aluminum and more efficient melting of the aluminum.

To help maintain stratification in the furnace, it is preferred that the non-oxidizing gas have a higher molecular weight or a greater density than the gas, or gases, employed in or generated by the burner. Proper buoyancy is thereby achieved that can suppress mixing of oxidizing gas from the burner with the non-oxidizing gas stream, particularly where there is a high volumetric flow through the burner.

Although the conditions to achieve proper stratification in an aluminum melting furnace are complex, the following criteria have been developed based on experimental studies and a mathematical analysis of the one dimensional diffusion of the combustion gases against the convective flow of the non-oxidizing gas from the aluminum surface. The preferred range of flow and furnace geometry conditions is expressed by $$UH/D>5$$

and the most preferred range is $$UH/D>50$$

U is the average convective velocity of non-oxidizing gas in the vertical or upward direction expressed in feet per second. It is defined as the volume flow rate of non-oxydizing gas in $ft^3$/sec, evaluated at furnace temperature, divided by the horizontal cross sectional area of the furnace. H is the vertical distance in feet between the axis of the burners and the surface of the aluminum bath after the charge has been melted. D is either turbulent diffusivity or molecular diffusivity in $ft^2$/sec of the oxidizing species. For most burners and gas ports for non-oxidizing gas, including laminar flames, turbulent diffusivity is estimated based on the following formula;

$$D=0.01\ dv$$

where d is the diameter of individual burner nozzle, or the diameter of a non-oxidizing gas port, in feet, and v is the nozzle velocity of the burner gas or non-oxidizing gas in feet per second. The larger of the two calculated diffusivities is used. For premixed radiant type burners the molecular diffusivity may be used.

To maintain stratification, a sufficient temperature gradient between the top and the bottom of the furnace is helpful. Generally, the aluminum charge acts as a heat sink, creating a substantial temperature difference within the furnace between points near the aluminum surface, and points near the combustion zone, i.e., near the burner. Typically, the temperature of the furnace atmosphere near the aluminum surface should be kept 200° F. to 500° F. lower than near the burner. Such a vertical temperature gradient results in a vertical density gradient, helping to maintain stratification. In other words, mixing of gases in the combustion stratum of the furnace and the non-oxidizing stratum is further reduced by the temperature gradient. For example, if at a 400°–500° F. temperature gradient 80 SCFH (standard cubic feet per hour) of non-oxidizing gas are required to obtain proper stratification, at a 10° F. temperature gradient 2000 SCFH of non-oxidizing gas might be required to achieve the same degree of stratification, i.e., to limit the presence of combustion gases near the aluminum charge to the same extent.

The furnace can be operated at normal temperatures that are required for melting aluminum with proper refractory material selection. It is believed that the combustion zone of the furnace can be operated up to a temperature of roughly 3000° F. while realizing advantages of the invention.

Stratification of the atmosphere within a furnace limits convective heating of the aluminum. It is therefore desirable that the furnace wall be kept at a high temperature (i.e., to provide radiant heating that makes up for the loss of convective heating). Since heat transfer in most industrial furnaces is dominated by radiation, and radiative heat transfer increases sharply with furnace temperature, a 50° to 200° F. increase in temperature is sufficient in most cases. Walls made of conventional refractory materials, e.g., alumina-silica bricks, will normally provide such re-radiation. If desired, however, the furnace can be constructed of special high temperature ceramic materials such as alumina-zirconia-silica bricks to operate at higher temperatures.

As noted above, the distance between the burner and the introduction point of the non-oxidizing gas can also be adjusted to increase stratification. In general, the greater the distance between them, the more stratification will be obtained. The orientation of the inlet port for the non-oxidizing gas can also be used to advantage.

Combustion using oxygen or oxygen-enriched air to burn fuel is preferable to combustion using air. Proper stratification is easier to achieve by using oxygen because the volume of combustion gas is reduced. Oxygen or oxygen-enrichment also provides more heat per unit volume of burner gas, resulting in fuel savings.

The following examples and comparative examples are presented for illustrative and comparative purposes. They are not intended to be limiting.

EXAMPLES

Figure 3:
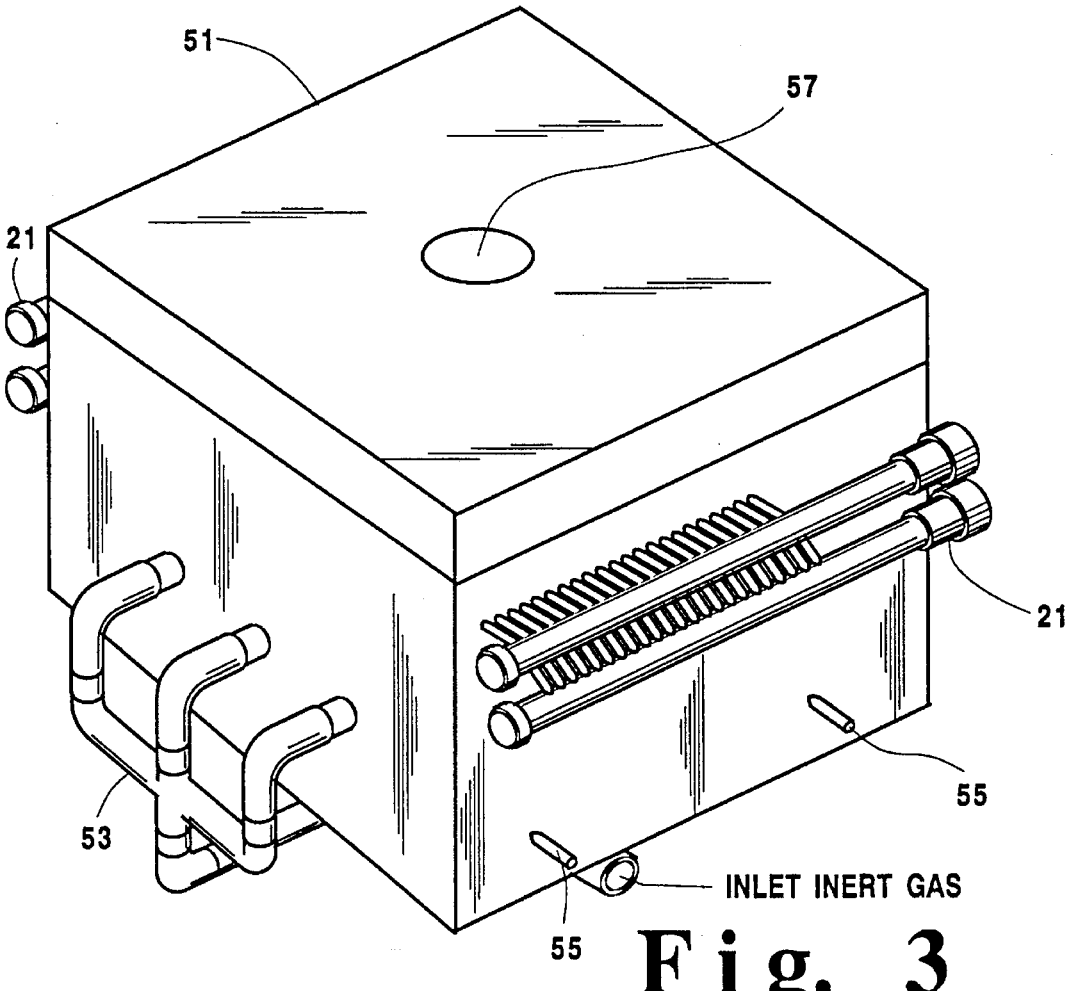
FIG. 3 depicts a furnace described in the working Example.

A small-scale furnace 51 having internal dimensions 2'×2'×2', shown schematically in FIG. 3, was constructed to demonstrate the invention. The burner was designed to combust natural gas combined with either air or oxygen in the upper zone of the furnace, while introducing inert nitrogen at the bottom of the furnace. The furnace was built from refractory bricks with a steel shell, the joints being welded to prevent air leakage. Six two-inch pipes 53 were placed six inches above the furnace floor, with three pipes on each of opposite sides of the furnace in symmetrical positions facing each other (i.e., injecting inert gas in a direction parallel to the furnace floor) to inject nitrogen gas over the charge. The pipes were designed to give a Reynolds number of less than 2300, i.e., to achieve laminar flow. The distance from the center of these pipes to the center of oxygen tubes of the burner was six inches; the roof was 4.5 inches above that. Water cooled pipes 55 were placed at the bottom of the furnace to simulate the heat sink of an aluminum load. Although only two pipes are shown in the drawing, many adjustable-length cooling pipes, with a flat refractory plate over the pipes to control the sink surface temperature, were used. A flue port 57 (diameter 2.5 inches) was placed in the middle of the furnace roof.

Figure 4:
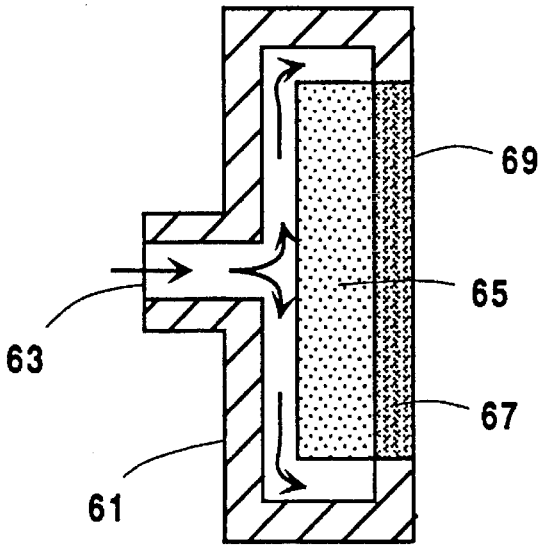
FIG. 4 depicts a radiant type burner described in the working Example.

Two types of burners were separately used: a radiant burner 61, shown schematically in FIG. 4, and a low-velocity laminar flame oxygen/fuel burner 21, shown in FIGS. 2 and 3.

The radiant type burner 61 employed natural gas as fuel which was premixed with air and introduced through intake port 63. Four 4"×6" radiant burners were placed in the roof of the furnace. The natural gas/air mixture first permeated a fine pore diffusion layer 65, and then a coarse pore diffusion layer 67. Combustion products exited the burner through the hot outer surface 69, and entered the furnace.

The low-velocity laminar flame type oxygen/fuel burner 21 contained 54 small copper tubes: 27 upper tubes for oxygen flow, and 27 lower tubes for fuel (natural gas) flow. The fuel tubes 27 were 0.25 inches in diameter (cross-sectional area of 0.0092 $ft^2$ per burner), and the oxygen tubes 29 were 0.38 inches in diameter (cross-sectional area of 0.021 $ft^2$ per burner). A smaller diameter was selected for the fuel tubes since they would accommodate a lower flow rate.

The furnace had a maximum operating temperature of 2200° F. A temperature difference of 400° F. between the top and bottom was created with cooling water through the cooling pipes at the bottom to simulate typical conditions with an aluminum load. The firing rate for the oxygen fuel burner was from 100,000 to 300,000 Btu/hour, and the average fuel and oxygen gas velocity was varied from 1.3 to 4.5 ft/sec. For the radiant burner, the firing rate was 100,000 to 150,000 Btu/hr, and the gas velocity varied from 1 to 1.4 ft/sec. To achieve complete fuel combustion, the oxygen fuel burner was fired with 2% excess oxygen on a wet basis and the radiant burner was fired with 10% excess air.

It took 2–3 hours for the furnace to reach a temperature difference of 400° F. between the top and bottom of the furnace. Measurements were then taken. The nitrogen flow rate was reduced until just over 1% by volume of $CO_2+O_2+H_2O$ was detected at the bottom of the furnace. Generally, very good stratification was achieved with a minimum of 250 SCFH of nitrogen. Oxidant ($O_2$ or air) and fuel flow rates were adjusted to maintain an oxidant/fuel volume ratio of 2.06 and 10.47 respectively for the oxygen fuel burner and radiant burner.

Different methods of introducing nitrogen were tested. Stratification was found to be very good when the nitrogen was injected through two sets of three ports positioned at opposite sides of the furnace. In this configuration, the ports were two inches in diameter, and the gas velocity was 0.45 ft/sec at 211 SCFH of nitrogen flow. Very good results were also obtained using three ports on one wall; the ports were two inches in diameter and the gas velocity was 0.90 ft/sec.

Figure 5:
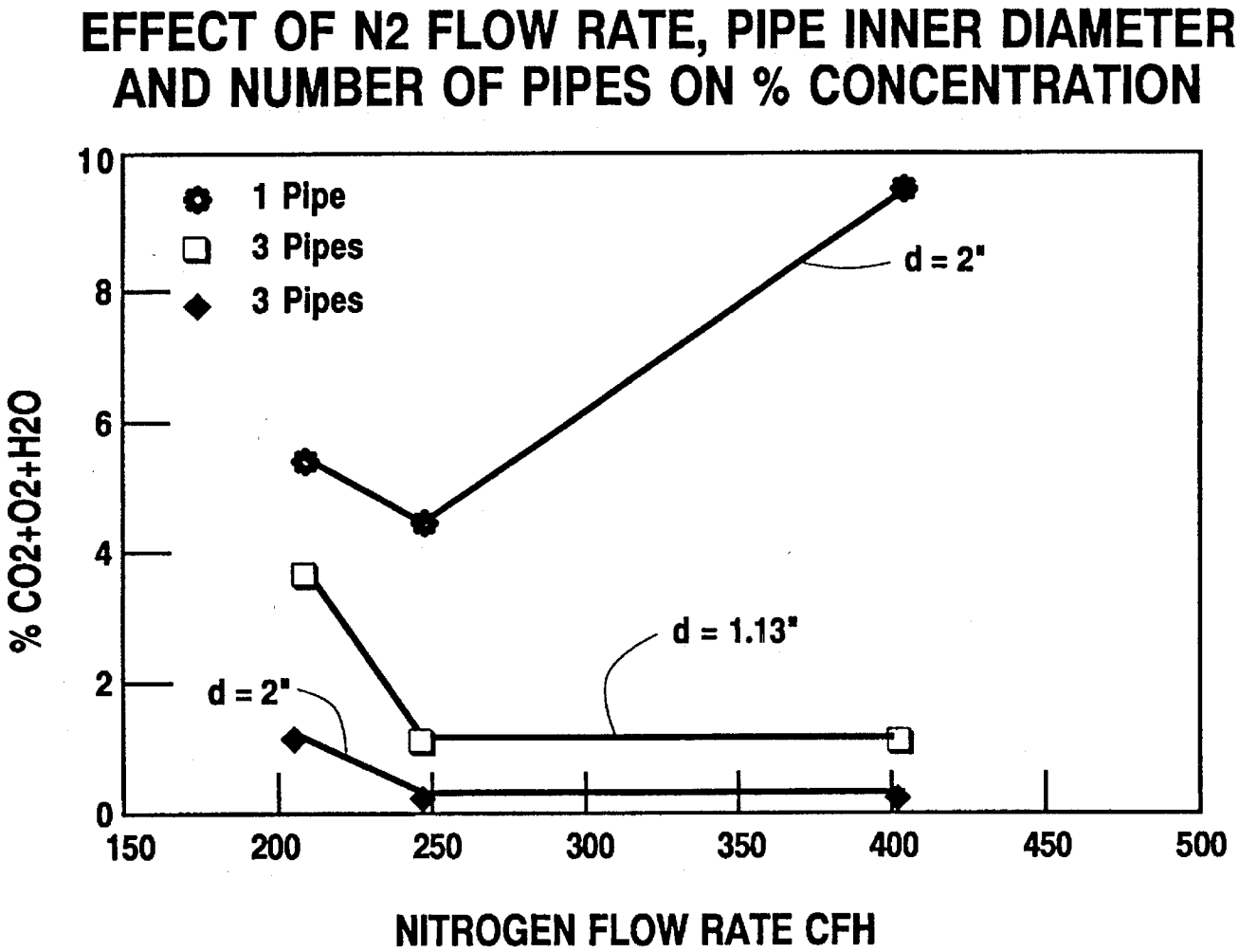
FIG. 5 is a graph of results from the working Example. It shows the volume percent concentration of $CO_2+O_2+H_2O$ as a function of nitrogen flow (in cubic feet per hour) for 1.13" or 2" inner diameter pipes, where 1, 3 or 6 pipes were used, to inject the nitrogen.

When the port diameter was reduced to 1.13 inches and nitrogen was injected from 3 ports on one wall at 2.5 ft/sec, performance started to deteriorate. The worst performance was observed when nitrogen was injected from a single 2 inch port at 2.5 ft/sec. These experiments demonstrated that it was beneficial to inject inert gas at a low velocity from multiple ports that were spaced to help create a protective stratum over the entire charge area. FIG. 5 shows the effect of nitrogen flow, pipe diameter and number of pipes on the percent concentration of $CO_2+O_2+H_2O$ for this furnace.

Experiments were also carried out varying the location of the flue port. The preferred locations were found to be near the top of one of the side walls, above the burners, and on the furnace roof. These locations prevented downward flow of combustion products. When the flue port was located below the burner, a substantial amount of oxidative combustion products mixed into the hearth area.

Figure 6:
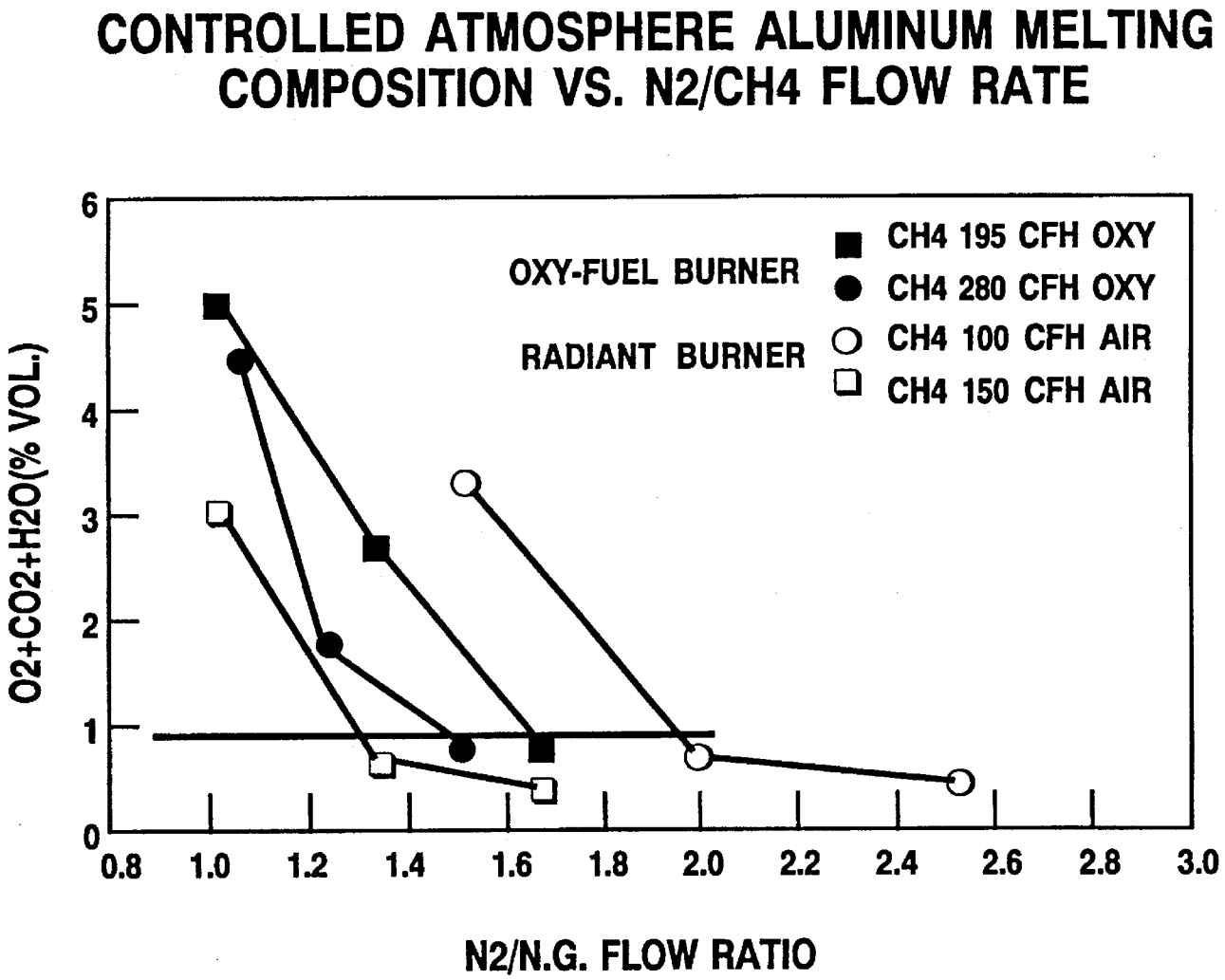
FIG. 6 is a graph of results from the working Example. It shows the volume percent concentration of $CO_2+O_2+H_2O$ as a function of the ratio of $N_2$ to natural gas for both an oxygen fuel burner and a radiant type burner.

FIG. 6 shows the results of tests of the oxygen fuel burner and the radiant type burner. Natural gas was applied at flow rates of 196 CFH and 280 CFH in the oxygen fuel burner, and 100 and 150 CFH in the radiant type burner ("$CH_4$" in the graph legend refers to natural gas). The ratio of nitrogen to natural gas was varied as well. The results show that less than 1% volume of $CO_2+O_2+H_2O$ was achieved at all four flow rates of natural gas, using both types of burners. Proper stratification was still obtained with a minimum nitrogen to natural gas flow ratio of 1.3. UH/D values were about 300 to 600 in these tests.

Figure 7:
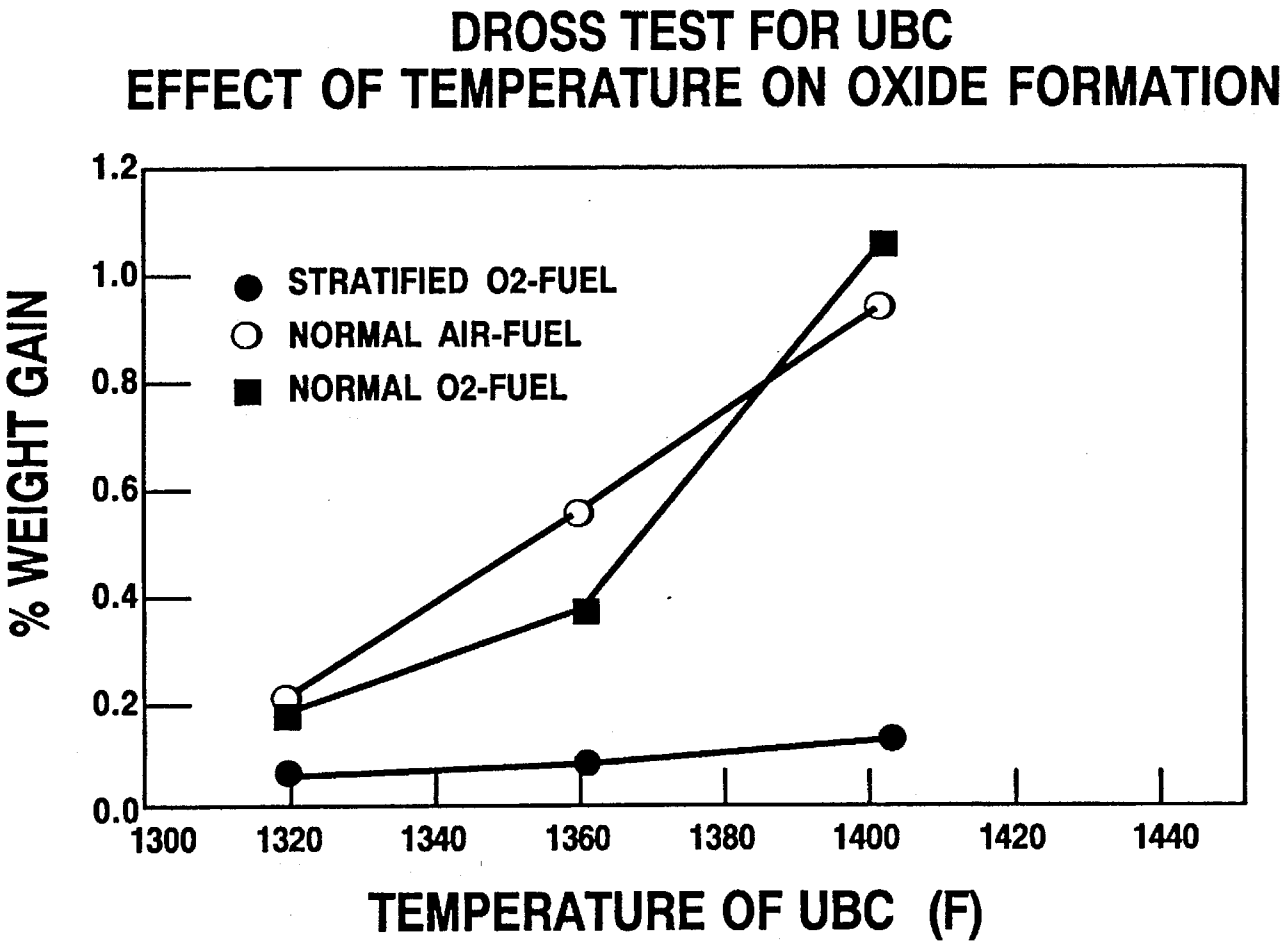
FIG. 7 is a graph of results from the working Example. It shows the results of an oxidation test carried out on used beverage cans (UBC) showing the benefit of the invention in reducing dross formation. The graph depicts the percent weight gain as a function of the temperature of the furnace in degrees F. Results from a stratified system using an oxygen/fuel type burner ("STRATIFIED $O_2$-FUEL"), an un-stratified system using an air/fuel burner ("NORMAL AIR-FUEL"), and an unstratified system using an oxygen/fuel burner ("NORMAL $O_2$-FUEL") are shown.

FIG. 7 is a graph of the results of an oxidation test carried out on used beverage cans showing the benefit of the stratified system of the invention in reducing dross formation. The furnace described above was used with a charge of used beverage cans. Percent weight gain (as a result of oxide formation) was measured for a stratified system using an oxygen fuel burner ("oxyfuel"), as opposed to for unstratified systems using either a radiant type burner ("airfuel") and an oxygen fuel burner. As seen in the figure, the amount of dross was dramatically reduced in the stratified system.

Although the invention has been described in detail with reference to certain preferred embodiments, those skilled in the art will recognize that there are other embodiments of the invention within the spirit and the scope of the claims. Moreover, it is believed that the general concept of this invention may be successfully applied to heating steel with reduced steel oxidation over that resulting from conventional steel heating practices.

We claim:

1. A process for melting a charge of aluminum in a direct-fired furnace comprising:

(A) introducing said charge of aluminum into said furnace;

(B) carrying out combustion from a burner which provides heat into said furnace, and emits combustion gases into said furnace to form a combustion gas layer within said furnace;

(C) melting said charge of aluminum to form a molten aluminum bath by radiant transfer of said heat to said aluminum charge;

(D) introducing non-oxidizing gas into the furnace between said combustion gas layer and the molten aluminum bath to create a non-oxidizing gas layer within said furnace which serves to reduce dross formed between a surface of said molten aluminum bath and the combustion gas layer; and (E) exhausting the combustion gases from the furnace at a point above the point where combustion gases are emitted into the furnace.

2. A process according to claim 1 carried out in accordance with the formula:

$$UH/D>5$$

wherein U is the average convective velocity of the non-oxidizing gas in feet per second, H is the vertical distance between the axis of the burner and the surface of the aluminum bath in feet, and D is the diffusivity of oxidizing gas from the burner in feet squared per second.

3. A process according to claim 1 wherein the non-oxidizing gas is introduced into the furnace through a plurality of injection ports located in the side walls of the furnace.

4. A process according to claim 1 wherein at least some of the non-oxidizing gas introduced into the furnace is first passed through the aluminum bath.

5. A process according to claim 1 wherein the non-oxidizing gas is from the group consisting of nitrogen, argon, hydrogen and hydrocarbons.

6. A process according to claim 1 wherein said burner emits a laminar flame.

7. A process according to claim 1 wherein the non-oxidizing gas has a laminar flow in the furnace.

8. A process according to claim 1 wherein said burner is a radiant burner.

9. A process according to claim 1 wherein said non-oxidizing gas exhausts through a flue in said furnace together with combustion products from said burner.

10. A process according to claim 1 wherein said burner is an oxygen-fuel type burner.

* * * * *